United States Patent [19]

Ito

[11] Patent Number: 4,806,048

[45] Date of Patent: Feb. 21, 1989

[54] APPARATUS FOR PRODUCING ARTIFICIAL WAVE

[75] Inventor: Soichi Ito, Tokyo, Japan

[73] Assignee: Nippon Kokan Kabushiki Kaisha, Tokyo, Japan

[21] Appl. No.: 153,320

[22] Filed: Feb. 8, 1988

[30] Foreign Application Priority Data

Feb. 27, 1987 [JP] Japan ..... 62-42729

[51] Int. Cl.[4] ..... E02B 3/00

[52] U.S. Cl. ..... 405/79

[58] Field of Search ..... 405/79; 4/491

[56] References Cited

U.S. PATENT DOCUMENTS

| | | | |
|---|---|---|---|
| 3,789,612 | 2/1974 | Richard et al. | 405/79 |
| 3,973,405 | 8/1976 | Duport | 405/79 |
| 4,507,018 | 3/1985 | Andersen | 405/79 |

FOREIGN PATENT DOCUMENTS

| | | | |
|---|---|---|---|
| 78906 | 4/1986 | Japan | 405/79 |

*Primary Examiner*—Randolph A. Reese
*Assistant Examiner*—John A. Ricci
*Attorney, Agent, or Firm*—Frishauf, Holtz, Goodman & Woodward

[57] ABSTRACT

An apparatus for producing an artificial wave, which comprises: an embankment provided in the sea in parallel to a shore so that the upper portion thereof is exposed above the sea, the embankment having on the off-shore side thereof a slope for causing sea water to crawl up over the embankment in the form of a wave, and on the inshore side thereof a vertical surfaces; a tank, having an open upper end, fitted to the embankment so as to be vertically movable along the vertical surface thereof, the tank having a capacity sufficient to receive sea water having crawled up over the slope of the embankment a plurality of times through the open upper end, a side wall on the inshore side of the tank being capable of being opened and closed; a main buoy, fixed onto a bottom wall of the tank, having buoyancy sufficient to cause substantially the entire of the tank to float up above the sea; and a tank supporting mechanism having a function of supporting the tank at a prescribed position above the sea, the tank supporting mechanism releasing the above-mentioned function thereof when the tank is filled up with sea water and the side wall on the inshore side of the tank being opened; whereby the tank filled up with sea water falls down on the sea along the vertical surface of the embankment and sea water received in the tank is discharged, thereby producing an artificial wave suitable for surfing toward the shore.

4 Claims, 3 Drawing Sheets

APPARATUS FOR PRODUCING ARTIFICIAL WAVE

FIELD OF THE INVENTION

The present invention relates to an apparatus for producing an artificial wave, which permits artificial production of a large wave suitable for surfing and the like on a shore.

BACKGROUND OF THE INVENTION

Surfing requires a high and large wave having a long cycle, i.e., a wave suitable for surfing. In order that such a wave suitable for surfing is produced on a shore, the shore should in general satisfy the following two conditions. One is that the topography of the sea bottom should have a proper slope to gradually increase the wave height toward the shore. The other is that swelling waves come surging relatively frequently toward the shore.

In spite of the sea surrounding Japan, only a few shores satisfy the two conditions as mentioned above, and many of the shores in Japan do not permit easy production of waves suitable for surfing, thus providing only a few chances for surf riders.

Even on a shore permitting surfing, on the other hand, a considerable change in weather or sea conditions may prevent production of a wave suitable for surfing. As a result, a surfing competition is often prevented from being held as planned.

Under such circumstances, there is a demand for an artificial-wave surfing shore where a wave suitable for surfing is constantly made available through artificial production.

However, there is not known at present an apparatus for producing an artificial wave, which permits production of a large artificial wave sufficient to allow surfing. The known trials to artificially produce a large wave include a method comprising placing concrete blocks or natural stones on the sea bottom to provide an appropriate slope on the sea bottom and thus producing a large wave by increasing the wave height, and another method comprising installing a smoothly convex structure on the sea bottom to deform a wave into a larger one, these constituting only examples in this area of research.

Under these circumstances, there is a demand for the development of an apparatus for producing an artificial wave, which permits artificial production of a wave suitable for surfing and the like on a shore, but such an apparatus for producing an artificial wave has not as yet been proposed.

SUMMARY OF THE INVENTION

An object of the present invention is therefore to provide an apparatus for producing an artificial wave, which permits artificial production of a wave suitable for surfing and the like on a shore.

In accordance with one of the features of the present invention, there is provided an apparatus for producing an artificial wave, comprising:

an embankment (1) provided in the sea substantially in parallel to a shore so that an upper portion thereof is exposed above the sea, said embankment (1) having, on the offshore side thereof, a slope (7) for causing sea water to crawl up over said embankment (1) in the form of a wave, and, on the inshore side thereof, a vertical surface (1*a* );

a rectangular parallelepiped tank (2), having an open upper end, fitted to said embankment (1) so as to be vertically movable along said vertical surface (1*a*) thereof, said tank (2) extending horizontally along said vertical surface (1*a*) of said embankment (1), said tank (2) having a capacity sufficient to receive sea water having crawled up over said slope (7) of said embankment (1) a plurality of times through said open upper end, and a side wall (14) on the inshore side of said tank (2), which side wall (14) is parallel to said vertical surface (1*a* ) of said embankment (1), being capable of being opened and closed with a first rotation axle (14*a*) as a fulcrum, which first rotation axle (14*a* ) is provided on the upper end of said tank (2) horizontally and in parallel to said vertical surface (1*a*) of said embankment (1);

a main buoy (13) fixed onto a bottom wall of said tank (2), said main buoy (13) having buoyancy sufficient to cause substantially the entire of said tank (2) to float up above the sea, and a lower surface (13*a* ) of said main buoy (13) inclining upwardly toward the shore;

a tank supporting mechanism (3) having a function of supporting said tank (2) at a prescribed position above the sea, said tank supporting mechanism (3) releasing said function thereof when said tank (2) is filled up with sea water; whereby said tank (2) falls down on the sea along said vertical surface (1*a* ) of said embankment (1) when said tank (2) is filled up with sea water, to push out sea water thereunder toward the shore, thereby producing an artificial wave (30) toward the shore; and an opening-closing mechanism (4) for opening and closing said side wall (14) on the inshore side of said tank (2) with said first rotation axle (14*a* ) as a fulcrum, said opening-closing mechanism (4) closing said side wall (14) when said function of said tank supporting mechanism (3) is active, and opening said side wall (14) when said function of said tank supporting mechanism (3) is released, whereby sea water received in said tank (2) is discharged toward the shore when said tank (2) falls down on the sea, thereby promoting said production of said artificial wave (30).

BRIEF DESCRIPTION OF DRAWINGS

FIGS. 4(A) to 4 vertical cross-sectional views illustrating production of an artificial wave in the apparatus for producing an artificial wave of the present invention shown in FIG. 1, wherein FIG. 4(A) shows the state in which the tank of the present invention, supported at the prescribed position above the sea, receives sea water having crawled up over the slope of the embankment a plurality of times.

DETAILED DESCRIPTION OF PREFERRED EMBODIMENTS

From the above-mentioned point of view, extensive studies were carried out with a view to developing an apparatus for producing an artificial wave, which permits artificial production of a high and large wave suitable for surfing and the like on a shore.

As a result, the following finding was obtained: By converting the accumulated energy for a plurality of natural waves into a single wave and thus producing a single artificial wave, it is possible to produce a higher and larger artificial wave suitable for surfing and the like even from a plurality of small natural waves on the shore. More specifically, it is possible to repeatedly produce higher and larger artificial waves suitable for surfing and the like even from a plurality of small natural waves on the shore, by providing an embankment, which has on the offshore side thereof a slope, and on the inshore side thereof a vertical surface, in the sea substantially in parallel to the shore so that the upper portion of the embankment is exposed above the sea; fitting an elongate tank, which has an open upper end and an openable side wall on the inshore side, to the embankment so as to be vertically movable along the vertical surface thereof; causing sea water to crawl up over the slope of the embankment in the form of a wave; receiving sea water having thus crawled up over the slope of the embankment into the tank supported at a prescribed position above the sea a plurality of times through the open upper end of the tank; causing the tank thus filled up with sea water to fall down on the sea along the vertical surface of the embankment to push out sea water thereunder toward the shore, and at the same time, opening the side wall on the inshore side of the tank to discharge sea water received in the tank toward the shore; and repeating the above-mentioned steps.

The present invention was made on the basis of the above-mentioned finding. The apparatus for producing an artificial wave of the present invention is described below in detail with reference to the drawings.

Figure 1:
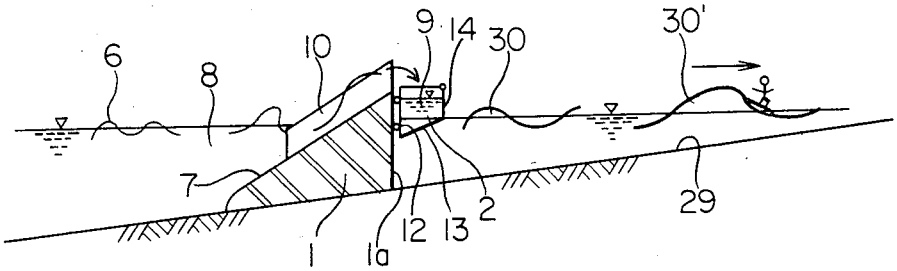
FIG. 1 a vertical cross-sectional view illustrating an outline of the apparatus for producing an artificial wave of invention.
Figure 2A:
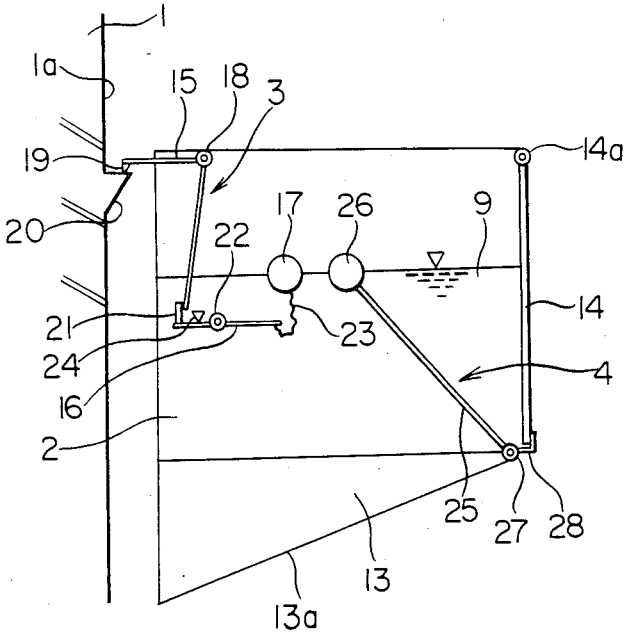
FIG. 2 (A) is a vertical cross-sectional view illustrating a state in which a function of tank supporting mechanism and a function of an opening-closing mechanism of a side wall on the inshore side of a tank are active in the apparatus for producing an artificial wave of the invention shown in FIG. 1.
FIG. 2(B) is a vertical cross-sectional view illustrating a state in which the function of the tank supporting mechanism and the function of the opening-closing mechanism of the side wall on the inshore side of the tank are released in the apparatus for producing an artificial wave of the present invention shown in FIG. 1.

FIG. 1 is a vertical cross-sectional view illustrating an outline of the apparatus for producing an artificial wave of the present invention; FIG. 2(A) is a vertical cross-sectional view illustrating a state in which a function of a tank supporting mechanism and a function of an opening-closing mechanism of a side wall on the inshore side of a tank are active in the apparatus for producing an artificial wave of the present invention shown in FIG. 1, and FIG. 2(B) is a vertical cross-sectional view illustrating a state in which the function of the tank supporting mechanism and the function of the opening-closing mechanism of the side wall on the inshore side of the tank are released in the apparatus for producing an artificial wave of the present invention shown in FIG. 1.

Figure 2B:
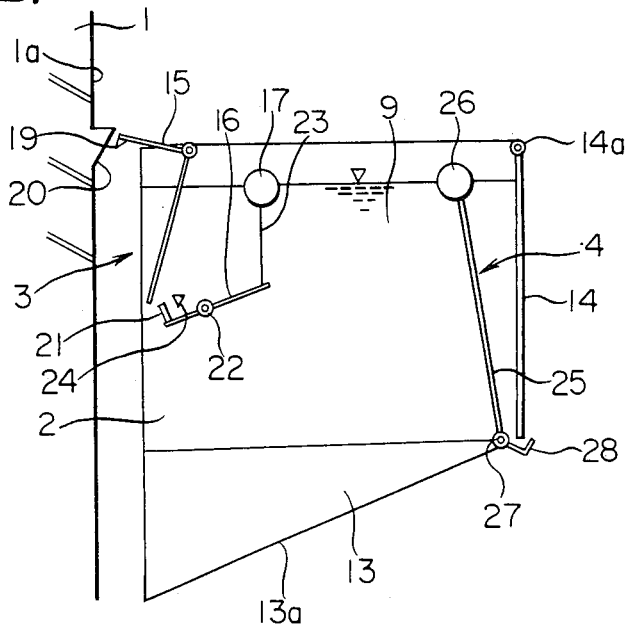

As shown in FIGS. 1, 2(A) and 2(B), the apparatus for producing an artificial wave of the present invention basically comprises an embankment 1 provided in the sea 8, a tank 2 fitted to the embankment 1, a main buoy 13 fixed onto a bottom wall of the tank 2, a tank supporting mechanism 3 for supporting the tank 2 at a prescribed position above the sea 8, and an opening-closing mechanism 4 for opening and closing a side wall 14 on the inshore side of the tank 2.

The embankment 1 is provided in the sea 8 substantially in parallel to a shore not shown so that an upper portion thereof is exposed above the sea 8 even at high tide. The embankment 1 has on the offshore side thereof a slope 7 for causing sea water to crawl up over the embankment 1 in the form of a wave 6, and on the inshore side thereof a vertical surface 1*a*.

The tank 2 comprises a rectangular parallelepiped body having an open upper end and extends horizontally along the vertical surface la of the embankment 1. The tank 2 is fitted to the embankment 1 so as to be vertically movable along the vertical surface 1*a* of the embankment 1 by causing rollers 12 provided on a side wall on the offshore side of the tank 2, which side wall is parallel to the vertical surface 1*a* of the embankment 1, to engage with a vertical guide rail not shown provided on the vertical surface 1*a* of the embankment 1. The tank 2 has a capacity sufficient to receive sea water 9 having crawled up over the slope 7 of the embankment 1 in the form of a wave a plurality of times through the open upper end of the tank 2. A side wall 14 on the inshore side of the tank 2, which side wall 14 is parallel to the vertical surface 1*a* of the embankment 1, can be opened and closed with a first rotation axle 14*a* as the fulcrum, which first rotation axle 14*a* is provided on the upper end of the tank 2 horizontally and in parallel to the vertical surface 1*a* of the embankment 1.

The main buoy 13 is fixed onto a bottom wall of the tank 2. The main buoy 13 has buoyancy sufficient to cause substantially the entire of the tank 2 to float up above the sea. A lower surface 13*a* of the main buoy 13 inclines upwardly toward the shore.

The tank supporting mechanism 3 has a function of supporting the tank 2 at a prescribed position above the sea 8, and releases the above-mentioned function thereof when the tank 2 is filled up with sea water 9. As shown in FIGS. 2(A) and 2(B), the tank supporting mechanism 3 comprises a plurality of inverted L-shaped tank supporting rods 15, a plurality of constraining rods 16, and a plurality of first buoys 17.

The plurality of tank supporting rods 15 are fitted to a second rotation axle 18 provided on the upper portion of the tank 2 horizontally and in parallel to the vertical surface 1*a* of the embankment 1, and are tiltable with the second rotation axle 18 as the fulcrum. As shown in FIG. 2(A), one end 19 of each of the tank supporting rods 15 is capable of engaging with a projection 20 surface 1*a* of the embankment 1, provided on the vertical thereby being adapted to support the tank 2 at the prescribed position above the sea 8.

The plurality of constraining rods 16 are fitted to a third rotation axle 22 provided on the tank 2 below and in parallel to the second rotation axle 18, and are tiltable with the third rotation axle 22 as the fulcrum. As shown in FIG. 2(A), each of the constraining rods 16 has at one end thereof a stopper 21 which engages with the other end of the tank supporting rod 15, thereby being adapted to cause the one end 19 of the tank supporting rod 15 to engage with the projection 20 on the vertical surface 1*a* of the embankment 1. In FIGS. 2(A) and 2(B), 24 represents a stopper for restricting the position of each tank supporting rod 15 within a certain range.

Each of the plurality of first buoys 17 is connected to the other end of each of the constraining rods 16 with a rope 23. As shown in FIG. 2(B), the first buoy 17 floats up when the tank 2 is filled up with sea water 9 to raise the other end of the constraining rod 16 through the rope 23 with the third rotation axle 22 as the fulcrum to release engagement of the stopper 21 on the one end of the constraining rod 16 with the other end of the tank supporting rod 15, thereby releasing the function of the tank supporting mechanism 2 of supporting the tank 2 at the prescribed position above the sea. This causes the tank 2 to fall down on the sea along the vertical surface 1*a* of the embankment 1 when the tank 2 is filled up with sea water; whereby sea water under the tank 2 is pushed out toward the shore by means of the lower surface 13*a*, which inclines upwardly toward the shore, of the main buoy 13 fixed onto the bottom wall of the tank 2, thereby producing an artificial wave toward the shore.

In order to permit full use of the apparatus for producing an artificial wave of the present invention irrespective of high tide or low tide, it is desirable to determine the above-mentioned prescribed position above the sea for supporting the tank 2 so that the one end 19 of each of the tank supporting rods 15 engages with the projection 20 provided on the vertical surface 1*a* of the embankment 1 when the empty tank 2 is caused to float up at its highest position above the sea at low tide under the effect of buoyancy of the main buoy 13.

The opening-closing mechanism 4 has a function of opening and closing the side wall 14 on the inshore side of the tank 2 with the first rotation axle 14*a* as the fulcrum. The opening-closing mechanism 4 closes the side wall 14 during the above-mentioned function of the tank supporting mechanism 3 of supporting the tank 2 at the prescribed position above the sea 8 is active, and opens the side wall 14 during the function of the tank supporting mechanism 3 is released. As shown in FIGS. 2(A) and 2(B), the opening-closing mechanism 4 comprises a plurality of opening-closing rods 25 and a plurality of second buoys 26.

The plurality of opening-closing rods 25 are fitted to a fourth rotation axle 27 provided on the lower end of the tank 2 horizontally and in parallel to the vertical surface 1*a* of the embankment 1, and are tiltable with the fourth rotation axle 27 as the fulcrum. As shown in FIG. 2(A), each of the opening-closing rods 25 has at one end thereof a hook 28 for engaging with a lower end of the side wall 14 on the inshore side of the tank 2 to close the side wall 14.

Each of the plurality of second buoys 26 is secured to the other end of each of the opening-closing rods 25. As shown in FIG. 2(B), the second buoy 26 floats up when the tank 2 is filled up with sea water 9 to raise the other end of the opening-closing rod 25 with the fourth rotation axle 27 as the fulcrum, thereby releasing engagement of the hook 28 on the one end of the opening-closing rod 25 with the lower end of the side wall 14 on the inshore side of the tank 2 to open the side wall 14. Sea water 9 received in the tank 2 is discharged through the thus opened side wall 14 toward the shore when the tank 2 falls down on the sea, thereby promoting production of the artificial wave by the fall of the tank 2.

Figure 3:
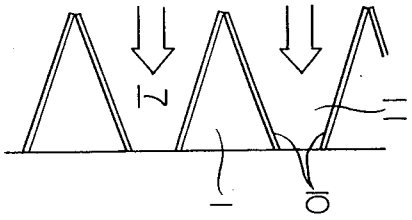
FIG. 3 is a plan view illustrating a state in which a plurality of pairs of wave collecting plates are provided on a slope of an embankment in the apparatus for producing an artificial wave of the present invention shown in FIG. 1.

As shown in FIG. 3, a plurality of pairs of wave collecting plates 10 should preferably be provided on the slope 7 of the embankment 1 at prescribed intervals in the longitudinal direction of the embankment 1. The pairs of wave collecting plates 10 are arranged so as to form a plurality of channels 11 which gradually narrow toward the shore for sea water having crawled up on the slope 7 of the embankment 1 in the form of a wave. By providing the pairs of wave collecting plates 10 on the slope 7 of the embankment 1 as described above, it is possible to cause sea water having crawled up on the slope 7 of the embankment 1 to reach a higher position through reduction of the flow width and acceleration of the flow velocity by means of the channels 11 formed by the pairs of wave collecting plates 10. It is thus possible to cause the tank 2 to receive sea water 9 having crawled up over the slope 7 of a taller embankment 1 and further increase the potential energy of sea water 9 received in the tank 2, by providing the taller embankment 1 in the sea 8 and supporting the tank 2 at a higher position above the sea 8.

The number of the apparatuses for producing an artificial wave as described above to be installed depends upon the required length determined from the area of the shore to be used as a surfing shore and the topographic features of the shore.

Figure 4A:
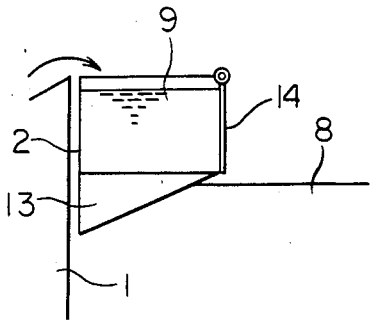
Figure 4B:
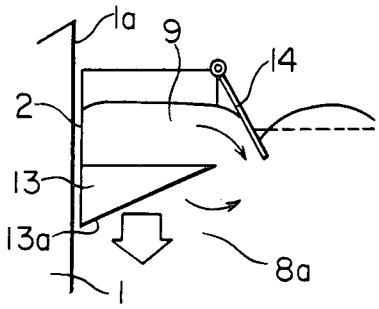
FIG. 4(B) shows the state in which the tank filled up with sea water is falling down on the sea.
Figure 4C:
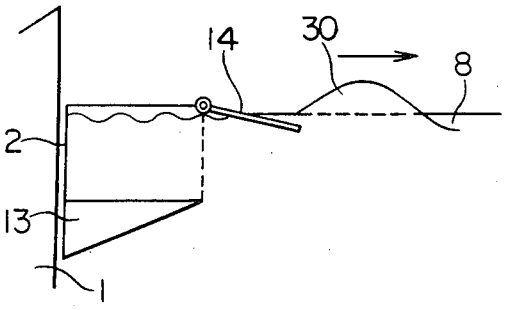
FIG. 4(C) shows the state in which an artificial wave is produced.

According to the apparatus for producing an artificial wave of the present invention, an artificial wave suitable for surfing is produced as follows: Sea water crawls up over the slope 7 of the embankment 1 provided in the sea 8 in the form of a wave 6. The empty tank 2 fitted to the vertical surface 1*a* of the embankment 1 is first supported at the prescribed position above the sea 8 by means of the tank supporting mechanism 3, and the side wall 14 on the inshore side of the tank 2 is closed by means of the opening-closing mechanism 4, as described above. The empty tank 2 receives sea water 9 having crawled up over the slope 7 of the embankment 1 a plurality of times through the open upper end thereof until the tank 2 is filled up with sea water 9, as shown in FIG. 4(A). When the tank 2 is filled up with sea water 9, the function of the tank supporting mechanism 3 of supporting the tank 2 at the prescribed position above the sea is released, and at the same time, the opening-closing mechanism 4 opens the side wall 14 on the inshore side of the tank 2, as described above. As a result, the tank 2 filled up with sea water 9 falls down on the sea 8 along the vertical surface la of the embankment 1, as shown in FIG. 4(B). The lower surface 13*a*, which inclines upwardly toward the shore, of the main buoy 13 fixed onto the bottom wall of the tank 2 pushes out sea water 8*a* thereunder toward the shore, and at the same time, sea water 9 received in the tank 2 is discharged through the thus opened side wall 14 toward the shore. As a result, as shown in FIG. 4(C), a higher and larger artificial wave 30 suitable for surfing is produced toward the shore from a plurality of small natural waves 6 on the shore. The thus produced artificial wave 30 has the wave height increasing toward the shore if the sea bottom 29 has an appropriate inclination toward the shore as shown in FIG. 1, thus forming a further larger wave 30′ more favorable for surfing.

Figure 4D:
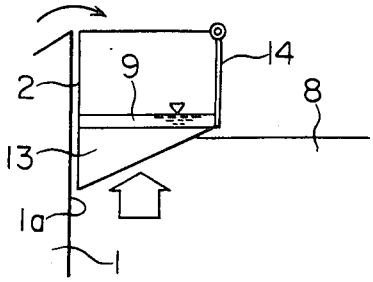
FIG. 4(D) shows the state in which the empty tank floats up above the sea under the effect of buoyancy of the main buoy.

The tank 2 having fallen down on the sea 8 floats up above the sea 8 as shown in FIG. 4(D) under the effect of buoyancy of the main buoy 13 while discharging sea water in the tank 2 through the opened side wall 14. Then, as shown in FIG. 2(A), the tank 2 is supported again at the prescribed position above the sea 8 by the tank supporting mechanism 3, and the side wall 14 on the inshore side of the tank 2 is closed again by the opening-closing mechanism 4. The tank 2 then receives again sea water 9 having crawled up over the slope 7 of the embankment 1 a plurality of times, thus producing another artificial wave 30 suitable for surfing in a similar manner.

According to the present invention, as described above in detail, the energy for a plurality of natural waves accumulated to some extent is converted into a single artificial wave. It is therefore possible to produce a higher and larger artificial wave suitable for surfing and the like even from a plurality of small natural waves on the shore, thus providing industrially useful effects.

What is claimed is:

1. An apparatus for producing an artificial wave, comprising:

an embankment (1) provided in the sea substantially in parallel to a shore so that an upper portion thereof is exposed above the sea, said embankment (1) having on the offshore side thereof a slope (7) for causing sea water to crawl up over said embankment (1) in the form of a wave, and on the inshore side thereof a vertical surface (1*a*);

a rectangular parallelepiped tank (2), having an open upper end, fitted to said embankment (1) so as to be vertically movable along said vertical surface (1*a*) thereof, said tank (2) extending horizontally along said vertical surface (1*a*) of said embankment (1), said tank (2) having a capacity sufficient to receive sea water having crawled up over said slope (7) of said embankment (1) a plurality of times through said open upper end, and a side wall (14) on the inshore side of said tank (2), which side wall (14) is parallel to said vertical surface (1*a*) of said embankment (1), said side wall being capable of being opened and closed with a first rotation axle (14*a*) as a fulcrum, which first rotation axle (14*a*) is provided on the upper end of said tank (2) horizontally and in parallel to said vertical surface (1*a*) of said embankment (1*a*);

main buoy (13) fixed onto a bottom wall of said tank (2), said main buoy (13) having buoyancy sufficient to cause substantially the entire of said tank (2) to float up above the sea, and a lower surface (13*a*) of said main buoy (13) inclining upwardly toward the shore;

a tank supporting mechanism (3) having a function of supporting said tank (2) at a prescribed position above the sea, said tank supporting mechanism (3) releasing said function thereof when said tank (2) is filled up with sea water; whereby said tank (2) falls down on the sea along said vertical surface (1*a* ) of said embankment (1) when said tank (2) is filled up with sea water, to push out sea water thereunder toward the shore, thereby producing an artificial wave (30) toward the shore; and an opening-closing mechanism (4) for opening and closing said side wall (14) on the inshore side of said tank (2) with said first rotation axle (14*a* ) as a fulcrum, said opening-closing mechanism (4) closing said side wall (14) when said function of said tank supporting mechanism (3) is active, and opening said side wall (14) when said function of said tank supporting mechanism (3) is released, whereby sea water received in said tank (2) is discharged toward the shore when said tank (2) falls down on the sea, thereby promoting said production of said artificial wave (30).

2. The apparatus as claimed in claim 1, wherein said tank supporting mechanism comprises:

a plurality of inverted L-shaped tank supporting rods (15) tiltable with a second rotation axle (18) as a fulcrum, which second rotation axle (18) is provided on the upper portion of said tank (2) horizontally and in parallel to said vertical surface (1*a*) of said embankment (1), one end (19) of each of said tank supporting rods (15) being engageable with a projection (20) provided on said vertical surface (1*a* ) of said embankment (1), for thereby supporting said tank (2) at said prescribed position above the sea;

a plurality of constraining rods (16) tiltable with a third rotation axle (22) as a fulcrum, which third rotation axle (22) is provided on said tank (2) below and in parallel to said second rotation axle (18), each of said constraining rods (16) having at one end thereof a stopper (21) which engages with the other end of said tank supporting rod (15), for thereby causing said one end (19) of said tank supporting rod (15) to engage with said projection (20) on said vertical surface (1*a* ) of said embankment (1); and a plurality of first buoys (17) each connected to the other end of each of said plurality of constraining rods (16) with a rope (23), said first buoys (17) floating up when said tank (2) is filled up with sea water to raise said other end of said constraining rod (16) through said rope (23) with said third rotation axle (22) as a fulcrum to release said engagement of said stopper (21) on said one end of said constraining rod (16) with said other end of said tank supporting rod (15), thereby releasing said function of said tank supporting mechanism (3) of supporting said tank (2) at said prescribed position above the sea.

3. The apparatus as claimed in claim 2, wherein aid opening-closing mechanism (4) comprises:

a plurality of opening-closing rods (25) tiltable with a fourth rotation axle (27) as the fulcrum, which fourth rotation axle (27) is provided on the lower end of said tank (2) horizontally and in parallel to said vertical surface (1*a* ) of said embankment (1), each of said opening-closing rods (25) having at one end thereof a hook (28) for engaging with a lower end of said side wall (14) on the inshore side of said tank (2) to close said side wall (14); and a plurality of second buoys (26) each secured to the other end of each of said plurality of opening-closing rods (25), said second buoy (26) floating up when said tank (2) is filled up with sea water to raise said other end of said opening-closing rod (25) with said fourth rotation axle (27) as the fulcrum, thereby releasing said engagement of said hook (28) on said one end of said side wall (14) to open said side wall (14).

4. The apparatus as claimed in claim 1, wherein said opening-closing mechanism (4) comprises:

a plurality of opening-closing rods (25) tiltable with a fourth rotation axle (27) as a fulcrum, which fourth rotation axle (27) is provided on the lower end of said tank (2) horizontally and in parallel to said vertical surface (1*a* ) of said embankment (1), each of said opening-closing rods (25) having at one end thereof a hook (28) for engaging with a lower end of said side wall (14) on the inshore side of said tank (2) to close said side wall (14); and a plurality of second buoys (26) each secured to the other end of each of said plurality of opening-closing rods (25), said second buoys (26) floating up when said tank (2) is filled up with sea water to raise said other end of said opening-closing rod (25) with said fourth rotation axle (27) as a fulcrum. thereby releasing said engagement of said hook (28) on said one end of said opening-closing rod (25) with said lower end of said side wall (14) to open said side wall (14).

* * * * *

UNITED STATES PATENT AND TRADEMARK OFFICE

CERTIFICATE OF CORRECTION

PATENT NO. : 4,806,048

DATED : February 21, 1989

INVENTOR(S) : Soichi ITO

It is certified that error appears in the above-identified patent and that said Letters Patent is hereby corrected as shown below: On the title page:

In the Abstract, line 8, change "surfaces" to --surface--.

Column 5, line 12, change "mechanism 2" to --mechanism 3--.

Column 7, line 38 (claim 1), change "embankment (1a)" to --embankment (1)--.

Column 7, line 39 (claim 1), before "main", insert --a--.

Column 7, line 68 (claim 2), after "mechanism", insert --(3)--.

Column 8, line 36 (claim 3), change "Claim 2" to --Claim 1--.

Column 8, line 36 (claim 3), change "aid" to --said--.

Column 8, line 39 (claim 3), change "the fulcrum" to --a fulcrum--.

Column 8, line 52 (claim 3), change "the fulcrum" to --a fulcrum--.

Column 8, line 54, between "one end of" and "said side wall", insert --said opening-closing rod (25) with said lower end of--.

UNITED STATES PATENT AND TRADEMARK OFFICE

CERTIFICATE OF CORRECTION

PATENT NO. : 4,806,048

DATED : February 21, 1989

INVENTOR(S) : Soichi ITO

It is certified that error appears in the above-identified patent and that said Letters Patent is hereby corrected as shown below:

Column 8, line 56 (claim 4), "Claim 1" to --Claim 2--.

Column 9, line 4 (claim 4), change "." to --,--.

Signed and Sealed this

Eighth Day of May, 1990

*Attest:*

*Attesting Officer*

HARRY F. MANBECK, JR.

*Commissioner of Patents and Trademarks*